United States Patent [19]

Paulos

[11] 4,407,502

[45] Oct. 4, 1983

[54] MATRIX PUZZLE GAME

[76] Inventor: John A. Paulos, 609 Martin La., Dresher, Pa. 19025

[21] Appl. No.: 307,968

[22] Filed: Oct. 2, 1981

[51] Int. Cl.[3] ..... A63F 9/08

[52] U.S. Cl. ..... 273/153 S; 273/155

[58] Field of Search ..... 273/153 S, 155, 157 R

[56] References Cited

FOREIGN PATENT DOCUMENTS

| | | | |
|---|---|---|---|
| 88312 | 11/1921 | Austria | 273/157 R |
| 170062 | 12/1977 | Hungary | 273/153 S |
| 55-3956 | 1/1980 | Japan | 273/153 S |

OTHER PUBLICATIONS

"Notes on Rubik's Magic Cube" by David Singmaster, publ. by Enslow Publishers, Hillside, NJ p. 38.

*Primary Examiner*—Anton O. Oechsle

*Attorney, Agent, or Firm*—John J. Simkanich

[57] ABSTRACT

A three-dimensional puzzle game having six sides comprising a cube wherein each side includes nine squares forming three columns intersecting three rows, any of the columns and rows being rotatable about an orthogonal axis of the cube with a single individual such rotation being accomplishable at a time, each of the six sides carrying a different integrated, invertible pictorial design with interchangeable portions which appear on each of the nine squares of each side.

10 Claims, 2 Drawing Figures

MATRIX PUZZLE GAME

BACKGROUND OF THE INVENTION

This invention relates to toys and game apparatus and especially puzzles with movable parts.

A standard Rubik cube is a "3×3×3" cube, any of whose six "3×3×1" sides can rotate about its center square in such a way that the cube as a whole does not fall apart. Each of the nine squares appearing on each side initially is colored, uniformly, the same color, with each of the six sides of the cube carrying a different color. Repeated rotations of various ones of the rows and columns comprised of individual squares thoroughly scrambles the colors.

As the Rubik cube becomes scrambled, the solution to the cube, i.e., organizing the cube with each of the six sides uniformly colored, goes beyond the ability and patience of most people. Even for those people who can solve the puzzle, its scrambled states are uninteresting and its desired solutions too few to sustain the interest of the player for a long period of time.

An object of the present invention is to create a three-dimensional puzzle cube whose six sides carry individualistic designs, portions of which appear on each of nine squares comprising each side.

A second object of the present invention is to provide such designs which, when scrambled, create other harmonious designs which can appear as certain simple solutions to the puzzle.

A further object of the invention is to provide such designs having portions with specific orientation so that an ideal solution to the puzzle takes into consideration the orientation of the center one of the individual small squares comprising a side, as well as the combination of specific ones of these squares.

SUMMARY OF THE INVENTION

The objects of this invention are realized in a three-dimensional puzzle game incorporated into a "3×3×3" cube, any of whose six "3×3×1" sides can rotate in columnar or row fashion about its center in such a way that the cube as a whole does not fall apart. Each side includes nine squares forming three columns intersecting three rows. An individual and unique integrated, invertible pictorial design appears on each of the six sides and is carried in part by each of the nine individual squares forming each such side of the cube.

The integrated invertible pictorial designs carried by each side may be invertible human faces. Such integrated designs comprise an assembly (or collection) of composite parts, which parts interact to give a contiguous presentation which provides a harmonious complete design having matching or mating lines or designs at the mating points of the composite parts. The sides of the cube have interchangeable corners and interchangeable edges, and the orientation of the center square of the human face on each side of the cube is important.

The cube in its start or pristine position (solved state) carries these pictorial human face designs with portions of each in each of the nine squares of a side whereby the center square carries a color (generally in the eyes of the face) which is identical to the color of a peripheral line forming a frame for the pictorial design, this color running as a narrow line along the outside edge of that side of the cube. Six different and distinct colors are used in each of the six center squares and the matching periphery color line about each such pictorial face.

DESCRIPTION OF THE DRAWINGS

The features, advantages and operation of the invention may be further learned from a reading of the following detailed description of the invention in conjunction with the accompanying drawings in which like numerals refer to like elements and in which.

DETAILED DESCRIPTION OF THE INVENTION

Figure 1:
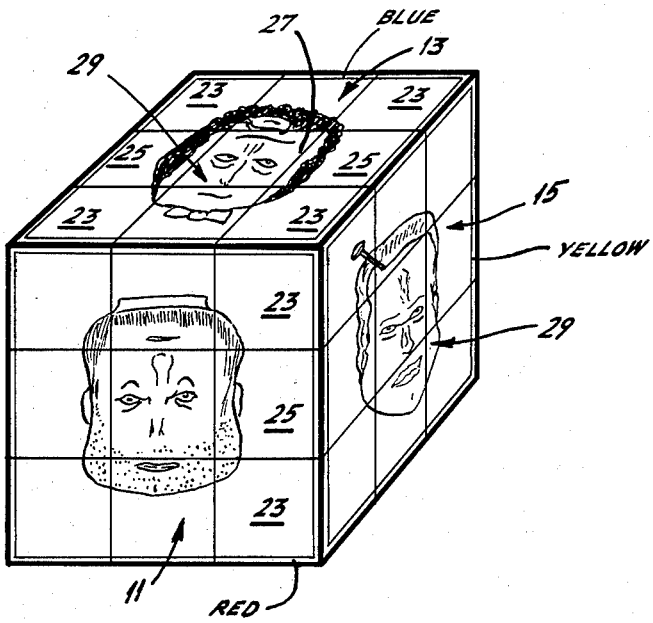
FIG. 1 shows a perspective view of the puzzle cube illustrating the first, second and third sides of the cube with the respective individual pictorial human face designs in the start position.
Figure 2:
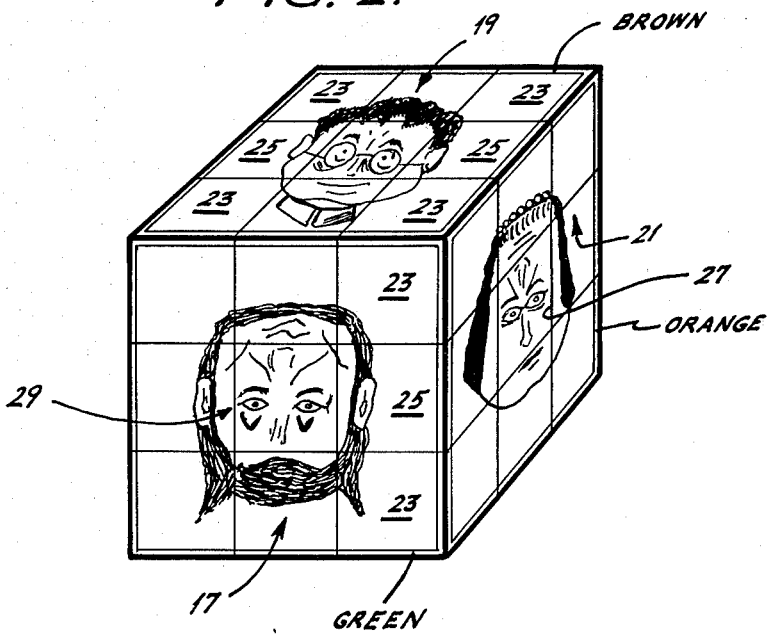
FIG. 2 shows a perspective view of the puzzle cube illustrating the fourth, fifth and sixth sides of the cube with the respective individual pictorial human face designs in their start position.

A three-dimensional puzzle game is shaped in the form of a six-sided cube having integrated, invertible pictorial human face designs. The cube has interchangeable corners and interchangeable edges so that nine individual squares comprise each side of the cube and the orientation of the center square is important. FIGS. 1 and 2 show in perspective views the six sides of the cube.

FIG. 1 shows the first face 11, second face 13 and third face 15 of the puzzle cube. FIG. 2 shows the fourth face 17, fifth face 19 and the sixth face 21 of the puzzle cube.

The cube itself is made of 26 elements; of these there are eight corner elements 23, twelve edge elements 25 and six center elements 27. These elements are assembled to form the standard type Rubik cube structure which is a "3×3×3" cube, any of whose six "3×3×1" sides can rotate about its center square in such a way that the cube as a whole does not fall apart. Each of the sides 11, 13, 15, 17, 19 and 21, therefore, is made up of nine squares (four corner squares 23, four edge squares 25, one center square 27) formed in these intersecting rows and columns.

The mechanical structure forming the cube has been known as "Rubik's Cube" and has been manufactured and sold by Logical Games, Inc., Haymarket, VA, and Ideal Toy Corporation, New York, NY. This mechanical structure has been described in *Scientific American,* March, 1981. A three-axis center spindle, providing rotation of any axis, establishes three orthogonal axes of rotation for individual center squares 27 for each side of the cube. Corner elements 23 and edge elements 25 are held together and to the center square elements 27 by interlocking mechanisms which permit movement along orthogonal axes without disassembly of the cube.

Each of the sides 11, 13, 15, 17, 19 and 21, contains a different and unique picture of a human face which is invertible. Each of these human faces 29 is invertible so that when viewed upside down, it presents a different pictorial presentation of a face than when viewed from the other angle.

Each of the sides 11, 13, 15, 17, 19 and 21 of the cube, when assembled in their start position, provide the ideal solution. A peripheral color line (indicated by letters R, B, Y, G, Br, O) extends about the edge of each particular side 11, 13; 15, 17, 19, 21. This color line is different and unique for each such side. In the principal embodiment, this edge color line is red for the first side 11, blue for the second side 13, yellow for the third side 15, green for the fourth side 17, brown for the fifth side 19, and orange for the sixth side 21. Any selection of colors can be used as alternatives. These color edge lines can even be eliminated from some embodiments of the puzzle cube.

Each of the human faces 29 is centered on and about the center square 27 of each of the sides 11, 13, 15, 17, 19, 21 of the cube. The eyes and nose portion of each face 29 appears in this center square 27. The color of the eyes of each human face is coordinated to the peripheral line color of the ideal solution.

Each of the distinct human faces 29 designs are positioned and sized so that as the elements 23, 25, 27 of the cube are rotated, facial lines will match up so that different combinations of facial features may be logically and pictorially combined. Likewise, the facial features are uniformly distributed amongst the nine squares which make up any side 11, 13, 15, 17, 19, 21. The background color of the cube surface is white, while the human face outlines are created by black and gray shadings.

The faces 29 can become different faces under 180° rotations and, to a quite limited extent, under 90° and 270° rotations. This is made possible since the eyes appear roughly in the center of the head. Other features of the human faces 29 are divided amongst the other squares so that portions of each of the human faces 29 are interchanged as the cube is rotated by its rows and columns.

The scrambled states of the faces 29 on the cube would not be devoid of interest. Many of them would depict strange, humorous and distorted faces (about $2\times10^{10}$ of them). Thus, in addition to the still reasonable goal of restoring the original six human faces 29, the player could fiddle idly with the cube to see what results would be obtained. Or he could try to achieve a certain desired face having particular eyes, mouth, ears and hair style.

With this puzzle game, the orientation of the center squares 27, i.e. center elements 27, is important. The puzzle will not look the same if this center square is rotated 90°. In this sense, solving the puzzle of this invention is more difficult than solving the standard Rubik-type cube. In the Rubik-type cube puzzle, a sequence of moves which rotates a center square element 27 is not important. With the puzzle of this invention, such a rotation of the center square 27, which leaves the other elements 23, 25 invariant, must be considered, as it changes a face 29. (The eyes might even end up vertical.)

To rotate the center square and leave every other square alone, one must perform a particular sequence of moves. A notation is helpful here. The letter "F" indicates a clockwise rotation of a front side 11 of the puzzle, "F*" indicates a counter-clockwise rotation of the front side 11 of the puzzle, "R" indicates a clockwise rotation of the right side 15 of the puzzle, "R*" indicates a counter-clockwise rotation of the right side 15 of the puzzle, and the letters "L" represent left, "B" represent back, "U" represent upper, and "D" represent down, with their inverses represented by "L*", "B*", "U*" and "D*", respectively. In each case, the direction, clockwise or counter-clockwise, is determined by viewing directly that particular side of the cube puzzle in question.

A particular sequence of moves which leaves all of the squares making up a particular side invariant, but rotates the center square of the upper side 13 90° clockwise, and the center square of the front side 11 90° counter-clockwise, can be expressed by the following: F, B*, L, R*, U, D*, F*, U*, D, L*, R, F*, D, U.

A sequence of moves which rotates the center square 27 of the upper side 13 90° clockwise, and the center square 27 of the down side 19 90° counter-clockwise, and which leaves every other square invariant, can be expressed as follows: R, L*, F, B*, F, B*, R, L*, U, R, L*, F, B*, F, B*, R, L*, D*.

Similarly, a sequence of moves which rotates the center square 27 of the upper side 13 180° clockwise, and which leaves every other square in the cube invariant, is expressed as follows: U, R, L, U, U, R*, L, U, R, L, U, U, R*, L. Similar such sequences exist for the other sides of the puzzle cube of the subject invention.

None of this is required, of course, to randomly fiddle with the cube and create a plurality of integrated, invertible faces.

The human faces 29 designs extend into each of the outside squares formed by the elements 23, 25 of each of the sides 11, 13, 15, 17, 19, 21 of the cube approximately one-third of the way so that the foreheads, chins, sides of the head and ears may articulate as the cube is rotated on its columns and rows. As an example, hair-forehead can be interchangeable with a mouth-chin, as well as right and left foreheads with left and right chins. Possible interchanges also include collar to cap, necklace to crown, and mouth to furrows in forehead.

When the cube is in its pristine or start position defining the ideal solution, the eye color of the center square of each face 29 will agree with the border or peripheral line. Thus, it is possible to play the puzzle of the subject invention with the goal of the standard Rubik-type cube puzzle.

Since the faces 29 remain faces when rotated 180°, and since different mouths, ears, eyes and hair styles may be interchanged, many different forms of the faces 29 can be formed which provide acceptable solutions to the puzzle.

The human faces 29 are arrived at as integrated composite of the respective nine squares forming each of the faces or sides 11, 13, 15, 17, 19 and 21 of the cube. With the three-dimensional matrix puzzle of this invention, corner elements 23 can be moved only into other corner positions and edge elements 25 only into other edge positions. Every element is not interpretable in every position. (This is why a similar scheme on a two-dimensional matrix will not work. There, every square would have to be interpretable in every way, since there every square can be moved to every position.)

The human faces 29 puzzle cube is, in one aspect of play, more difficult than the standard Rubik cube puzzle, since the player must concern himself with the orientation of the center square 27. This factor is not a concern for the standard Rubik cube puzzle, since rotation of the center square is not discernible. As stated above, when the cube is in the pristine position (original faces 29 in their original configuration), the eye color of the faces will agree with the border color line. Thus, in another aspect of play, the goal of a standard Rubik cube type puzzle, uniform coloring of each side without regard for the orientation of the eyes, is a possible and a reasonable solution for the puzzle cube of this invention (a special case of the more difficult ideal solution).

Since the human faces 29 remain faces when the center square elements 27 are rotated 180°, and since different mouths, ears, eyes, hair styles, etc., may be interchanged, in another aspect of play there are approximately $2\times10^{10}$ faces which may be formed. In this aspect of play, the invention provides entertainment and many easily attainable solutions for those of lesser skill.

Therefore, the subject invention is, in one mode of play more difficult, in another mode of play is equivalent to, and in a third mode of play is much easier to solve than the standard Rubik-type cube puzzle.

Many changes can be made in the above-described puzzle game without departing from the intent and scope thereof. By way of example, modifications can be made in the pictorial human face designs or other types of designs (geometric, script, animal forms or others) which can be substituted. These designs can be applied to the faces 11, 13, 15, 17, 19, 21 of the cube by printing, painting, gluing or other means. Other changes can also be made. It is intended, therefore, that all matter contained in the above description and shown in the accompanying drawings be interpreted as illustrative and not be taken in the limiting sense.

What is claimed is:

1. A puzzle game comprising:

a three-dimensional matrix cube with exclusively rotatable rows and columns of cube segments, each face of said cube being defined by a plurality of said cube segments, each cube segment on each face having a pictorial design component thereon which complements pictorial design components on adjacent cube segments on each face to form integrated composite invertible pictorial designs on each face in a plurality of rotated locations of rows and columns of said cube segments, including rotated locations thereof wherein selected cube segments are inverted.

2. The puzzle game of claim 1 where each pictorial design is a human face centered on a said face of said cube, each said face being formed by said cube portions and having interchangeable portions with each other said human face.

3. The puzzle game of claim 2 wherein said cube segments of each said face of said cube includes a plurality of squares made up of corner elements, edge elements and a center element of said cube.

4. The puzzle game of claim 3 wherein each said human face has its eyes and nose located on said center element of said side of said cube.

5. The puzzle game of claim 4 also including a color line about the peripheral edge of each face of said cube.

6. The puzzle game of claim 5 wherein each said color line is a different color.

7. The puzzle game of claim 6 wherein each said human face is a different face, each said human face presenting an even different pictorial face when viewed upside down.

8. The puzzle game of claim 7 wherein each said human face has eyes of a different color, each of said face eye color matching one of said peripheral edge line colors.

9. The puzzle game of claim 8 wherein each said side of said cube is white in background color.

10. The puzzle game of claim 9 wherein each said human face is presented by black and gray lines.

* * * * *